US008875343B2

(12) United States Patent
Hedlund et al.

(10) Patent No.: US 8,875,343 B2
(45) Date of Patent: Nov. 4, 2014

(54) DETACHABLE DUST CONTAINER WITH COVER FOR A VACUUM CLEANER

(75) Inventors: Tomas Hedlund, Västervik (SE); Torkel Ingre, Stockholm (SE)

(73) Assignee: AB Electrolux (SE)

( * ) Notice: Subject to any disclaimer, the term of this patent is extended or adjusted under 35 U.S.C. 154(b) by 391 days.

(21) Appl. No.: 13/319,497

(22) PCT Filed: Apr. 30, 2010

(86) PCT No.: PCT/SE2010/000115

§ 371 (c)(1),
(2), (4) Date: Jan. 23, 2012

(87) PCT Pub. No.: WO2010/128921

PCT Pub. Date: Nov. 11, 2010

(65) Prior Publication Data

US 2012/0110776 A1 May 10, 2012

Related U.S. Application Data

(60) Provisional application No. 61/176,660, filed on May 8, 2009.

(30) Foreign Application Priority Data

May 8, 2009 (SE) ..... 0900631

(51) Int. Cl.
*A47L 9/00* (2006.01)
*A47L 9/16* (2006.01)

(52) U.S. Cl.
CPC ..... *A47L 9/1683* (2013.01)
USPC ..... 15/347; 15/344

(58) Field of Classification Search
USPC ..... 15/347, 344, 350, 352, 353; 220/378
See application file for complete search history.

(56) References Cited

U.S. PATENT DOCUMENTS

RE32,751 E * 9/1988 Joss et al. ..... 15/329
4,967,443 A * 11/1990 Krasznai et al. ..... 15/347

(Continued)

FOREIGN PATENT DOCUMENTS

DE 3031024 9/1994
EP 0743039 11/1996

(Continued)

OTHER PUBLICATIONS

Report of Pretrial Reexamination, with English translation, for Japanese Application No. JP 2012-509759 dated Jun. 24, 2014.

(Continued)

*Primary Examiner* — Dung Van Nguyen
(74) *Attorney, Agent, or Firm* — RatnerPrestia

(57) ABSTRACT

Disclosed is a detachable dust container for collecting dust in a bagless vacuum cleaner, and a vacuum cleaner equipped with such a container. The dust container comprises a receptacle with a cover for selective opening and closing of the receptacle, enabling emptying of the receptacle. A sealing element consisting of a lip seal is arranged between the cover and the dust receptacle for establishing a substantially air tight and dust tight sealing between the dust receptacle and the cover. This sealing put lower demands than prior art solutions on a tight fit between the cover and the receptacle and allows for variations in the manufacturing of the two parts.

9 Claims, 2 Drawing Sheets

(56) References Cited

U.S. PATENT DOCUMENTS

| | | | | |
|---|---|---|---|---|
| 5,020,187 | A * | 6/1991 | Kosten et al. | 15/347 |
| 5,750,022 | A * | 5/1998 | Blake et al. | 210/167.12 |
| 6,818,032 | B2 | 11/2004 | Bilek et al. | |
| 7,201,786 | B2 | 4/2007 | Wegelin et al. | |
| 2004/0074213 | A1 | 4/2004 | Organ | |

FOREIGN PATENT DOCUMENTS

| | | |
|---|---|---|
| JP | 59-027758 | 2/1984 |
| JP | 61-181430 | 8/1986 |
| JP | 2005-261963 | 9/2005 |
| KR | 10-0354653 | 12/2002 |
| WO | WO 95/14422 | 6/1995 |

OTHER PUBLICATIONS

Notice of Termination of Pretrial Reexamination Report, with English translation, for Japanese Application No. JP 2012-509759 dated Jul. 1, 2014.

* cited by examiner

DETACHABLE DUST CONTAINER WITH COVER FOR A VACUUM CLEANER

This application is a U.S. National Phase application of PCT International Application No. PCT/SE2010/000115, filed Apr. 30, 2010 and claims priority to Swedish Patent Application No. 0900631-3 filed May 8, 2009, and the benefit of U.S. Provisional Application No. 61/176,660 filed May 8, 2009.

TECHNICAL FIELD

The present invention relates to a detachable dust container for use in a bagless vacuum cleaner, the dust container comprising a receptacle with a cover effectively sealed against the receptacle by means of a lip seal, and to a vacuum cleaner which incorporates such a dust container.

BACKGROUND

Bagless vacuum cleaners often use cyclonic separation to separate dirt and dust debris from an airflow. Bagless vacuum cleaners maintain a consistently high level of suction, even as the dust collecting container incorporated into the vacuum cleaner fills with dirt.

A bagless vacuum cleaner is a vacuum cleaner, which instead of utilizing a flexible bag, which may be disposable, for dust collection, uses a reusable container, which may be generally rigid, as compared with a bag.

The absence of a dust bag in the vacuum cleaner can make it difficult to dispose of the dirt and dust which is collected during the vacuuming. This can be solved by employing a removable dust collecting receptacle, which is easily disengaged from the vacuum cleaner body and emptied, and is for example shown in U.S. Pat. No. 7,201,786.

To be able to detach a dust-filled receptacle from the vacuum cleaner body and to move with the full dust receptacle to the dust bin for discharging of its content while maintaining the hygiene of the environment and the user's hands, the receptacle may be provided with a cover.

It is important that such a cover fits tightly on the dust receptacle, especially during operation of the vacuum cleaner, in order for air and dust not to escape from the dust collecting receptacle (or for air to enter the receptacle) and the separation efficiency of the vacuum cleaner hence being reduced. Nevertheless, it is difficult to manufacture a cover for a receptacle which fits tight enough all around the cover, and the permissible variation in the manufacturing tolerances of the two parts for such a device may be low, making it more difficult or expensive to manufacture.

Conventional sealing means, such as O-rings, are used in prior art solutions, e.g. in EP 0 743 039 and U.S. 2004/0074213, for sealing of the cover against the receptacle. Using O-rings, however, it is still of particular importance to achieve a tight fit between the cover and the receptacle and the locking of the cover in closed position is also very critical, since the sealing effect of O-rings is highly dependent on the compression pressure, axially between the receptacle and the cover.

The "axial direction" is understood as a direction which is substantially normal to an opening in the receptacle, which is to be closed by the cover. The "radial direction" is understood as a direction which is substantially perpendicular to the axial direction, and extends substantially from the perimeter of the opening and towards the middle of the opening. It is understood, that the opening may have a planar or non-planar perimeter, and/or that the opening may be symmetrically or asymmetrically shaped.

There is hence a need for a dust receptacle with a detachable cover which can be sealed against the receptacle all around the cover, and where the permissible variation in the manufacturing tolerances of the receptacle and the cover is higher and the demands on a tight fit between the two parts is lower than with prior art solutions.

SUMMARY

It is a general object of the present disclosure to eliminate or alleviate at least some of the disadvantages in prior art solutions.

It is further an object to provide a detachable dust container with an effectively sealed cover for use in a bagless vacuum cleaner, and to a vacuum cleaner incorporating such a container.

More specific objects include providing a dust container with an effectively sealed cover wherein the permissible variation in the manufacturing of the two parts is higher and the demands on a tight fit between the two parts is lower than with prior art solutions.

The invention is defined by the appended independent claims. Embodiments are set forth in the appended dependent claims and in the following description and drawings.

According to a first aspect, this object is achieved by a detachable dust container for collecting dust in a bagless vacuum cleaner, comprising a dust receptacle, a cover for selective opening and closing of the dust receptacle, enabling emptying of the receptacle, a sealing element arranged between the cover and the dust receptacle for establishing an effective sealing between the dust receptacle and the cover, wherein the sealing element is a lip seal.

"Cover" in this context could be any kind of lid or closing cover and could for example be a hinged lid or a separate lid. Instead of being comprised of a receptacle and a cover, the container could be a two-part container.

This type of detachable dust container could be uses, for example, in a canister type of vacuum cleaner, having a suction nozzle provided separately from the main body, in an upright type of vacuum cleaner in which a nozzle is integrated with the main body, in a stick type of vacuum cleaner or in a robotic vacuum cleaner.

By an "effective sealing" is meant a sealing which maintains the negative pressure in the dust receptacle. An effective sealing is both essentially air tight and essentially dust tight.

The lip seal is sealingly engageable with the opposite surface. Unlike O-rings, whose sealing effect is highly dependent on an axial compression pressure between the receptacle and the cover, the flexibly compressible lip of the lip seal has a self-sealing function. During operation of the vacuum cleaner, the lip seal between the receptacle and the cover is drawn radially inwards towards the opening between the cover and the receptacle by the vacuum formed in the vacuum cleaner. Simultaneously, a part of the seal exerts a sealing axial force against the opposite surface. This results in a sealing effect which increases the larger the difference in pressure between the inside and the outside of the receptacle becomes.

Due to the flexibility and extent of the lip seal, is it not necessary to provide tolerances against the opposite surface that are as close as with other kinds of seals, for example O-rings. The lip seal gives a substantially air tight and dust tight seal between the receptacle and the cover even though there is not a very tight fit of the two parts. Hence, the permissible variation in the manufacturing of cover and receptacle is not as limited as when other types of seals are to be used.

In one embodiment, the sealing element may be arranged with its base around a peripheral edge of the cover.

In another embodiment the sealing element may be arranged with its base around a peripheral edge of an opening in the dust receptacle.

The lip seal may be fastened around the peripheral edge by using glue, by pressing/squeezing the base of the lip seal into a slot or by snapping it into place using protuberances on the lip base.

Alternatively, the base of the lip seal may be squeezed or pressed into place between two separately formed parts of the cover. This is an advantage from the point of view of manufacture.

The lip seal may be made of resiliently compressible material, such as rubber or rubber like material.

The lip of the lip seal is a sealing flange extending from a base member of the lip seal. The flange may have a substantially convex part which is arranged to sealingly engage against the opposite surface.

In one embodiment the base member of the lip seal is provided with at least one longitudinal ridge, which may facilitate the attachment of the lip seal in a slot in the receptacle or in the cover and keeps the lip seal in place in the slot. For example, the ridge or ridges may interact with one or more correspondingly arranged groove or grooves in the slot.

According to a second aspect, this object is achieved by a bagless vacuum cleaner equipped with a detachable dust container for collecting dust, as described above.

BRIEF DESCRIPTION OF THE DRAWINGS

These and other aspects of the present invention will now be described in more detail, with reference to the appended drawings showing an embodiment of the invention.

DETAILED DESCRIPTION

Figure 1:
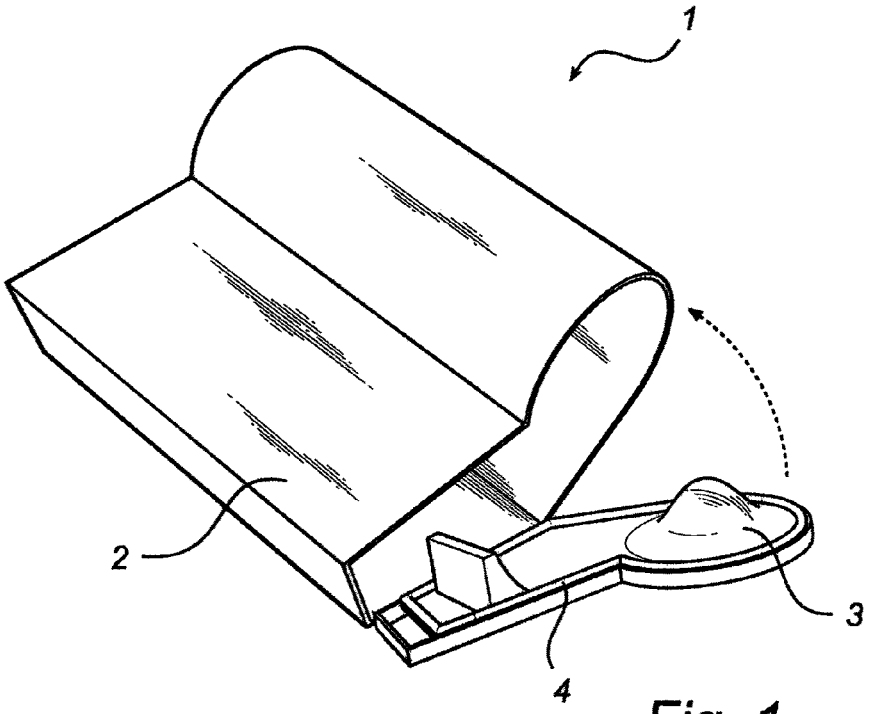
FIG. 1 shows a dust receptacle with cover.

Referring to the figures, a detachable dust container 1 for a bagless vacuum cleaner comprises a dust receptacle 2 which has a cover 3, FIG. 1. In order for the cover 3 to provide an effective sealing against the receptacle 2 it is equipped with a sealing member, a lip seal 4.

Figure 2:
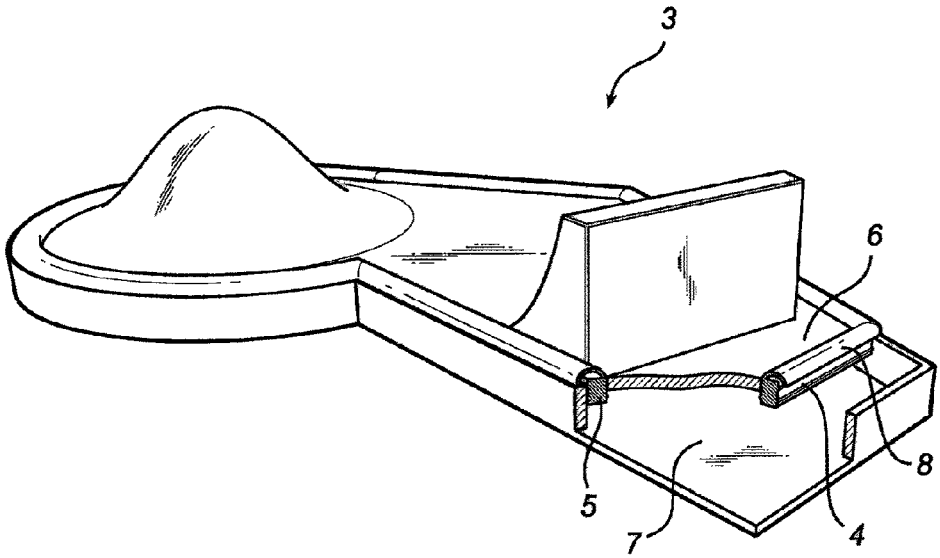
FIG. 2 shows a cover, where the base of the lip seal has been squeezed or pressed into place between two parts of the cover.

The lip seal 4 may be fastened to the lid by squeezing or pressing the base 5 of the lip seal 4 in between two separately formed parts 6, 7 of the cover 3, FIG. 2. The cover 3 may be hinged to the receptacle 2 or be a separate cover. It could further by locked into a closed position by e.g. a latch assembly.

Figure 3:
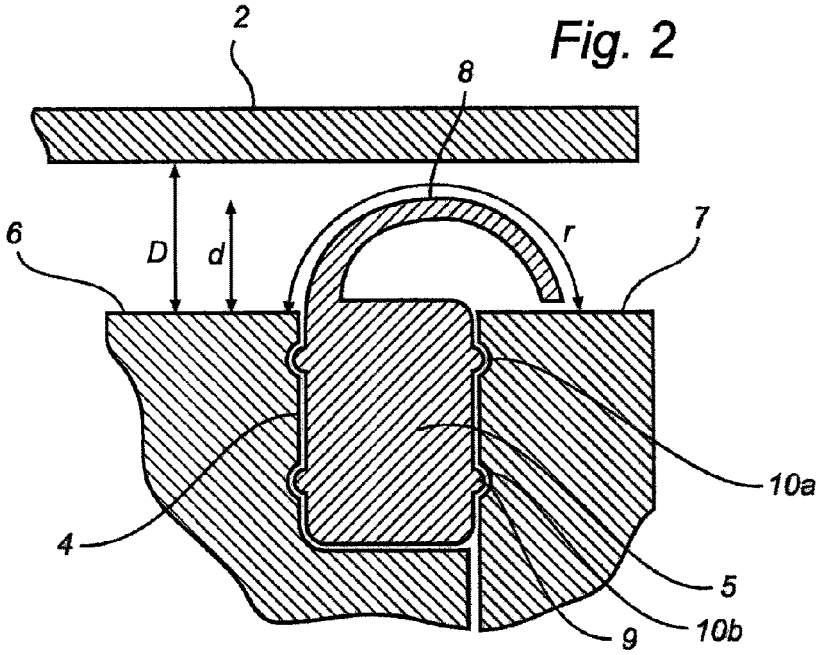
FIG. 3 shows a cross section of an embodiment of the lip seal.

In FIG. 3 an embodiment of the profile of the lip seal 4 is shown and is to be regarded as a non-limiting example. The lip seal 4 consists of a base member 5 and a flexible and compressible lip member 8 extending from the base member 5, where the lip member 8 is sealingly engageable with the receptacle 2. The base 5 of the lip seal 4 is of generally square or rectangular shape. The base member may be substantially symmetric. One, two, three or more longitudinal ridges 9 or grooves on the base member 5 may be provided to facilitate the attachment of the lip seal 4 in a slot in the receptacle 2 or in the cover 3, and keep the lip seal 4 in place. The ridges 9 may interact with one or more grooves 10*a*, 10*b* to provide a positive interlocking effect, thus keeping the lip seal 4 securely in place.

The sealing flange of the lip member 8 may be substantially arc-shaped but may equally well be straight. The flange could be of constant or varying thickness. It may extend from the side of the base member 5 or from the top of the same. It may be longer than the width of the base member 5 but it may also be shorter. The flange may extend beyond the side of the base member 5 opposing the attachment side.

The person skilled in the art realises that the present invention by no means is limited to the embodiments described above. On the contrary, many modifications and variations are possible within the scope of the appended claims.

For example the base 5 and the lip 8 of the lip seal 4 do not have to be made of the same material and could exhibit different qualities. The shapes of the receptacle 2 and the lid 3 are not limited to the embodiment shown in the figures, but could be of any suitable shapes.

It is recognized that the lip seal 4 may be designed to allow smaller or larger tolerances, e.g. by varying the axial and/or radial length, the thickness, cross section geometry and the material of the lip.

The lip member 8 may be designed to have an extent d in the axial direction in its non-compressed state, which is larger than a largest permitted distance D between the receptacle and the cover. In various embodiments, the lip member may extend 5%, 10%, 15%, 20%, 25%, 30%, 50%, 75%, 100%, 150%, 200% or 300% beyond that distance D. Alternatively, or as a complement, a length of the lip member 8, along a face r that is to engage the opposing part, may be 5%, 10%, 15%, 20%, 25%, 30%, 50%, 75%, 100%, 150%, 200%, 300%, 400% or 500% longer than said distance D.

The invention claimed is:

1. A detachable dust container for collecting dust in a bagless vacuum cleaner, the dust container comprising:

a dust receptacle;

a cover for selective opening and closing of said dust receptacle, enabling emptying of said receptacle; and a sealing element arranged between said cover and said dust receptacle for establishing an effective sealing between said dust receptacle and said cover, characterized in that said sealing element is a lip seal comprising a lip member and a base member, wherein the lip member extends away from the base member and turns back toward the base member.

2. A detachable dust container according to claim 1, wherein the base member is arranged around a peripheral edge of said cover.

3. A detachable dust container according to claim 1, wherein the base member is arranged around a peripheral edge of an opening in said dust receptacle.

4. A detachable dust container according to claim 2 or 3, wherein said base member of said lip seal is fastened around said peripheral edge by using glue, by pressing/squeezing said base member of said lip seal into a slot or by snapping it into place using protuberances on said base member.

5. A detachable dust container according to claim 2, wherein the base member is squeezed/pressed into place between two separately formed parts of said cover.

6. A detachable dust container according to claim 1, wherein said lip seal is made of resiliently compressible material.

7. A detachable dust container according claim 1, wherein the lip member is a sealing flange extending from a base member of said lip seal, said flange having a substantially convex part which is arranged to sealingly engage against an opposite surface.

8. A detachable dust container according to claim 1, wherein the base member comprises at least one longitudinal ridge.

9. A bagless vacuum cleaner equipped with a detachable dust container as described in claim 1.

* * * * *